United States Patent [19]

Stevenson et al.

[11] 3,977,324

[45] Aug. 31, 1976

[54] SABOTLESS MICRO PROJECTILE

[75] Inventors: Thomas Stevenson, Huntingdon Valley, Pa.; John J. Scanlon, Jr., Willingboro, N.J.

[73] Assignee: The United States of America as represented by the Secretary of the Army, Washington, D.C.

[22] Filed: Jan. 13, 1964

[21] Appl. No.: 337,506

[52] U.S. Cl. ..... 102/38; 102/92.4; 102/DIG. 1; 102/DIG. 7

[51] Int. Cl.[2] ..... F42B 9/16

[58] Field of Search ..... 102/92.5, 50, 38, 92.4; 76/108

[56] References Cited

UNITED STATES PATENTS

| | | | |
|---|---|---|---|
| 95,137 | 9/1869 | Potter | 102/92.5 |
| 142,394 | 9/1873 | Hope | 102/50 |
| 2,917,952 | 12/1959 | Lavellee | 76/108 |
| 3,008,258 | 11/1961 | Johnson | 102/38 |

FOREIGN PATENTS OR APPLICATIONS

| | | | |
|---|---|---|---|
| 14,347 | 1913 | United Kingdom | 102/50 |

*Primary Examiner*—Verlin R. Pendegrass
*Attorney, Agent, or Firm*—Nathan Edelberg; Robert P. Gibson; Arthur M. Suga

EXEMPLARY CLAIM

1. A dart type projectile having a bore size cylindrical portion of a length at least as long as the diameter thereof, a conical nose extending forwardly of said cylindrical portion and having a taper of substantially 16°, a rearwardly extending shaft, and four stabilizing fins having longitudinally extending peripheral edge portions longitudinally aligned with peripheral portions of said cylindrical portion, of an axial length at least that of said cylindrical portion, and of a width capable of supporting said projectile as the cylindrical portion leaves a smooth bore gun barrel, said shaft extending rearwardly from said cylindrical portion to said fins, the periphery of said fins and said cylindrical portion being concentric to within about one ten thousandth of an inch, said nose having a density substantially twice that of iron to reduce retardation to about one foot per second of velocity with an initial velocity of about 3,800 feet per second.

7 Claims, 4 Drawing Figures

INVENTORS
THOMAS STEVENSON
JOHN J. SCANLON
BY Harry M. Saragovitz
E. J. Kelly, H. Berl & S. Dubroff
ATTORNEYS:

SABOTLESS MICRO PROJECTILE

The invention described herein may be manufactured and used by or for the Government for governmental purposes without the payment to us of any royalty thereon.

The advantages in having the infantry possess a small dart type projectile, and a saving in weight of the weapon and rounds of ammunition to be carried, have been appreciated for many years. However that goal has not been previously attained in the best possible manner for design, function and maximum lightness in weight. An object of this invention is to effect a much closer approach to this goal than has heretofore been obtainable.

After years of effort perhaps the closest approach to the aforementioned desire for a light weight small size projectile has been a micro caliber projectile requiring a sabot which results in a super caliber of 0.22 inch and weighing about 16 grains with the sabot to give a high muzzle velocity of over 4700 feet per second with the aid of a sabot and weighing about 90 grains for one round to be fired. The difficulties incident to attaining adequate ballistic characteristics with lightness in weight without a sabot have been legion and so numerous as to have previously been thought unattainable. Were a steel dart type projectile made of the same shape and proportions that larger caliber artillery projectiles had been made and used without a sabot or with one, the results have not heretofore been satisfactory. With the sabot mentioned above the sabot and projectile together weigh almost twice what the weight of the projectile alone should be and the disconnection of the sabot at or after muzzle exit has been unsafe to friendly troops, if a stripper in the end of the barrel does not disintegrate the sabot properly. Accuracy of the projectile can be affected adversely if the stripper and sabot action do not function properly on every shot. Such a high goal is not probable since the stripper is subject to a high rate of wear and has a relatively short useful life. Were the 10 grain projectile alone to be fired at a velocity the same as that provided by the sabot but without any sabot being used, a much higher propellant pressure in the gun chamber would be needed and a much heavier and stronger gun would be required.

According to this invention the first ballistically satisfactory gun and projectile have been provided having a caliber of 0.125 inch without the inconvenience of a sabot. It has been empirically determined that a number of factors may be critical to satisfactory results, although it has not been determined what is the exact order of importance of these factors. In the gun there long has been found to be a 60,000 pound per square inch as the acceptable limit for propellant pressure and while longer barrels give a more desirable high velocity to a projectile this is objectionable in making a heavier weapon whereas the goal has been to provide lighter weight in both the projectile and gun. Low retardation of a projectile is important if a needed and accurate velocity at the target is to be obtained and excessive chamber pressure avoided. A desirable contour for this 0.125 inch diameter projectile had not previously been determined. The desired clearance between the inside diameter of the barrel and the outside diameter of the projectile to provide satisfactory gas seal and velocity without excessive heating of the barrel ahd chamber walls and danger of cook-off in a newly inserted round had to be determined. The desired inclination of stabilizing fins to the longitudinal axis to provide enough spin without too much retardation in the projectile velocity was not known. Neither was a desired taper for this projectile nose known, when retardation in projectile velocity was known to be important. Likewise what the weight of projectile should be to provide a desired momentum was not known.

Perhaps the most important three design factors in this invention may be said to be (a) the approximately 16° taper to the nose made of a metal about twice or more as heavy as steel, to give a high cross sectional density and reduce retardation in velocity of the projectile in flight, (b) the projectile being guided by two spaced or flat surfaces essentially bore diameter on it for travel within the gun barrel, the flat surface at the forward end or nose section being on the principal pressure application portion of the projectile for propulsion and that at the rear determined by the periphery of the fins to continue guidance and support of the projectile after the heavy nose and first guiding surface have left the muzzle to prevent the projectile axis sagging at the projectile forward end under gravity even an imperceptible amount that would become a perceptible deviation before reaching the target, and (c) the interference fit where the shaft is joined to the nose so that both sections hold together for firing through the barrel and in flight but come apart as two separate fragments when penetrating gelatin blocks thus improving lethality.

Figure 1:
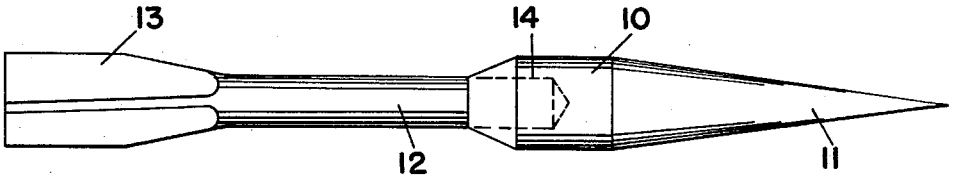
FIG. 1 is a longitudinal side view of a projectile embodying this invention.
Figure 4:
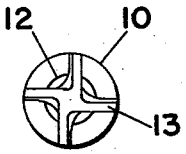
FIG. 4 is a rear end view of the projectile fins of FIG. 1.

Referring to FIG. 1 the projectile shown has a cylindrical body portion 10 which is at least about as long as is its diameter to provide a gas seal and to assist in guiding the projectile through a smooth bore barrel of the 0.125 inch diameter rifle. A nose 11 has a taper of about 16° (actually 15° 55′ 35″) to a sharp point, and is of a length of 0.445 ± 0.01 inches. The cylindrical body portion 10 of the nose is threadedly connected at 14 or fitted to shaft 12 by a press or interference fit, each preferably being subjected to an appropriate machining operation such that the peripheral cylindrical surfaces of the shaft 12 and nose portion 10 are concentric to each other and to their respective central axis. The shaft 12 has a diameter of 0.070 ± 0.001 inches and extends in rear of the body portion 10 a distance of at least about 0.3 of an inch. Integral with shaft 12 are formed four fins 13 having a bore size diameter for a longitudinal distance of about 0.158 ± 0.005 from their rear end. The center line of each fin forms an angle of about 1° 25′ to the longitudinal axis of the projectile for the purpose of imparting some stabilizing spin to the projectile during its flight. The length of the shaft and fins before being inserted into the body portion is about 0.753 ± 0.005 inches. The left end view of the projectile shown in FIG. 4 illustrates the approximate thickness of the fins (0.012 inch ± 0.002 inch) and the substantial fillets for reinforcing these fins at their base.

Figure 2:
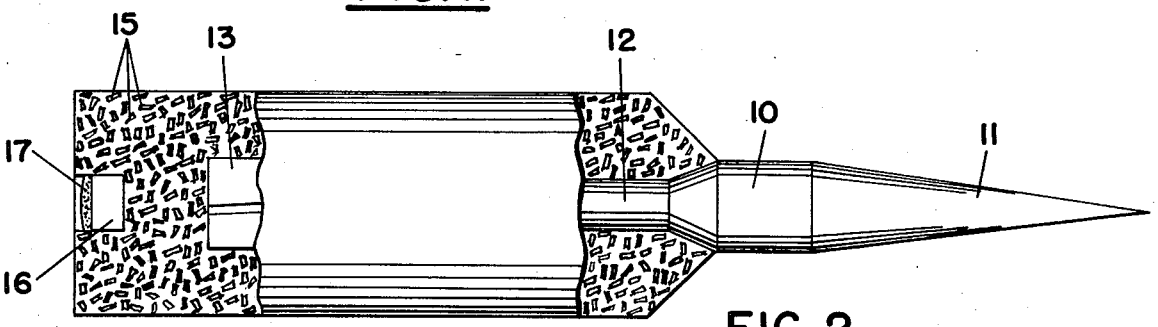
FIG. 2 is a side view of the projectile of FIG. 1 molded within a round of caseless propellant.

In FIG. 2 is shown the projectile of FIG. 1 molded into caseless propellant 15 having a primer mix 16 at its base end and a primer cap 17 for firing the primer from a percussion type firing pin. The caseless propellant is of the standard nitrocellulose type capable of being made into a suitable unit with appropriate solvent and binder according to the practice familiar to those skilled in the art of propellants and caseless propellants.

This caseless round has an overall length from the tip of the nose of 1.5 inches, the diameter of the propellant being 0.328 inch and the length of the propellant being 0.965 inch.

Figure 3:
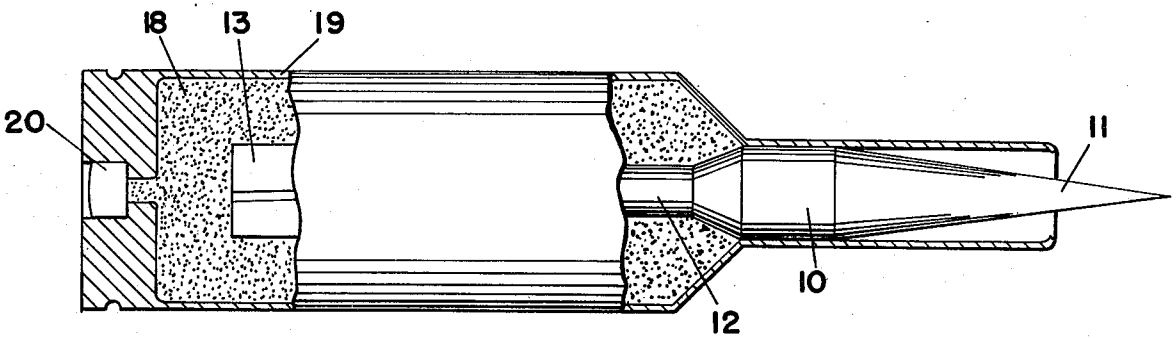
FIG. 3 shows the same projectile fixed within a brass case.

FIG. 3 illustrates the projectile of FIG. 1 held in a metal case 19 filled with propellant 18, of the granular sort provided with a suitable type primer 20.

This metal case has an overall length of 2¼ inches so that the sharp projectile point does not extend fully out of the case. The case diameter is 0.375 inches.

Several test barrels 22 to 26 inches long have been made with smooth bore for the experimental firings conducted. The chamber for the case 19 or caseless propellant 15 is of much larger diameter as is customary where substantial propellant pressure is needed.

Among the numerous features of this invention may be mentioned the unusual mass or weight in the integral nose portion 10. The nose 10 and shaft 12 are preferably connected by a controlled interference pressed fit in which the shaft 12 with a diameter of 0.072 inches is forced into a hole having a diameter of 0.070 inches. The shaft 12 and fins 13 are of ordinary steel hardened to about Rockwell C40. This portion 10 is preferably structurally integral and made from a machineable alloy of tungsten with 5 to 8 percent of nickel or from spent uranium alloyed with about 8 percent of molybdenum. By thus increasing the weight of the projectile its momentum is increased at a given velocity and therefore its retardation in velocity during flight is reduced. After assembly it is desirable to see that the two portions of this projectile are united concentrically to within about .0001 of an inch of concentricity by means of an optical comparator to reduce danger of some lack of concentricity causing a substantial error in flight. After being connected the entire projectile may be then subjected to a centerless grinding operation to assure obtaining the desired concentricity, i.e. rolled between two abradant surfaces. The ratio of length over diameter has been reduced to between 9 and 10. The muzzle velocity is approximately 3,800 feed per second attained in a 22 inch long barrel. With a 0.125 inch diameter bore, the bore size fins and cylindrical portion 10 have a diameter of 0.1245 ± 0.0002 inches after assembly and grinding. This projectile has been capable of having a retardation factor as low as 1 foot per second per foot of flight. The nose 11 has a hardness of Rockwell C25. This is believed to be the smallest bore size projectile and gun barrel ever tried without a sabot. Where a prior dart type projectile with sabot and cartridge case weighed 90 grains, this projectile with molded propellant of the same caliber weighs only about 35 grains and requires no metal case. The projectile weighs 18.5 grains, the propellant 17 grains, and the primer mix with cap 1 grain. There is minimum air disturbance at the muzzle on launching with less danger of yaw and with greater accuracy in flight. When made of the tungsten Mallory Alloy 1000 the nose 10 has a density of 16.7 and weighs 14.5 grains before being united with the shaft and fins weighing 4 grains, making the projectile 18.5 grains as stated above.

The shaft and fins could be of lighter weight metals. The cylindrical portion 10 needs to be at least about as long as the bore diameter to permit a satisfactory partial and guided insertion of the projectile into the gun barrel bore when the fins are surrounded by propellant in a larger diameter chamber. Without the fins being of a size to continue guiding the projectile during the final stage of launching and when the cylindrical portion 10 is out of the barrel, excessive yaw occurs to affect accuracy of fire. A high density nose with a gradual taper is needed for stability in flight and reduced retardation in velocity. The retardation of 1 foot per second per foot was measured at a distance of about 845 feet from the muzzle. A ballistic coefficient of about 0.360 has been found for this projectile.

The most important feature is that the projectile is sabotless, which avoids all the difficulties of sabot manufacture, assembly, stripping, inaccuracy, and danger of the stripper not functioning as it should. A next most important advantage is the reduced weight of the gun due to a short barrel length with the ability to obtain accuracy in flight of the projectile. The prior 0.22 inch caliber projectile with sabot requires 16 grains to be pushed by propellant through a gun barrel but delivers only a 10 grain projectile to the target. The present projectile of this invention requires propellant to push 18.5 grains through a gun barrel but delivers all 18.5 grains of weight to the target. Lethality tests in gelatin show the prior projectile will not tumble in gelatin or a body unless travelling 3,000 or more feet per second whereas the projectile of this invention will tumble in gelatin when travelling as low as 2,200 feet per second. The ability of the dart type projectiles to tumble in gelatin or in animal tissue is necessary because where tumbling produces an unusually large wound straight penetration produces a relatively small or non-lethal wound and probably would not be acceptable for combat use.

The projectile of this invention has outstanding lethality characteristics in that it not only will tumble and kill at a lower velocity or longer range than others but when it tumbles in gelatin the uneven forces being applied to the nose and shaft sections causes the relatively hard steel shaft to break the thin section of mallory metal holding the shaft producing two separate pieces, nose and shaft, which continue through the gelatin as two separate projectiles thus possibly increasing lethality or probability of kill.

A ballistic table comparing the present projectile with the closest known prior art projectile with a sabot and known as the XM-144 follows:

| | The Invention | XM-144 |
|---|---|---|
| Drag coefficient $K_D$ | 0.100 | 0.141 |
| Ballistic coefficient $C_1$ | 0.360 | 0.387 |
| Accuracy, mean circle diameter at 100 yards | 5.84" | 7.40" |
| Accuracy, mean circle diameter at 300 yards | 15.66" | 25.92" |

The drag coefficient is a measure of the air resistance offered by a projectile. Ballistic coefficient is a measure of the ability of a projectile to overcome air resistance and is expressed in one of several scales according to the caliber of the projectile, and is dependent upon mass, diameter, and form. The accuracy is in terms of the diameter of a mean or average circle to include the shots.

We claim:

1. A dart type projectile having a bore size cylindrical portion of a length at least as long as the diameter thereof, a conical nose extending forwardly of said cylindrical portion and having a taper of substantially 16°, a rearwardly extending shaft, and four stabilizing fins having longitudinally extending peripheral edge portions longitudinally aligned with peripheral portions of said cylindrical portion, of an axial length at least that of said cylindrical portion, and of a width capable of supporting said projectile as the cylindrical portion leaves a smooth bore gun barrel, said shaft extending rearwardly from said cylindrical portion to said fins, the periphery of said fins and said cylindrical portion being concentric to within about one ten thousandth of an inch, said nose having a density substantially twice that of iron to reduce retardation to about one foot per second of velocity with an initial velocity of about 3,800 feet per second.

2. A projectile according to claim 1 in which a tight fit connection secures said shaft to said cylindrical portion and said fins having a canted inclination of between about one and two degrees to a longitudinal axis of said projectile.

3. A projectile according to claim 2 in which said shaft is about 0.072 inches in diameter, about 0.327 inches in length excluding a threaded forward end and said fins are about 0.283 inches long and each fin is outwardly tapered from the diameter of said shaft rearward to the diameter of said fins.

4. A projectile according to claim 3 in which the forward portion of said projectile secured to said shaft is of a metal alloy capable of being machined and having substantially a density of 16 to reduce retardation of the projectile.

5. A projectile according to claim 4 having a major portion of said shaft and all of said fins embedded in a propellant.

6. A projectile comprising a steel shaft section, a nose section having a tungsten alloy portion positioned forwardly adjacent said shaft section, and means of press-fittingly attaching said shaft section to said nose alloy portion for holding them together under launch and flight conditions and yet enabling their separation upon striking an object, so constructed and arranged that separate fragments may inflict separate damage to said object.

7. In a combination with a tubular member having a smooth bore a dart type projectile in said bore to be fired therefrom, said projectile having a cylindrical body portion extending rearwardly of a tapered nose, a shaft of less diameter than said body portion, fins attached to and extending rearwardly of said shaft, and a propellant around said fins and shaft of larger diameter than said fins and extending rearwardly of said fins, the combination therewith of the improvement for enhancing accuracy in flight of said projectile and reducing retardation in flight of said projectile velocity during flight to a target, said improvement including the fins and cylindrical body portion each having equal peripheral dimensions and substantially being of bore size enabling the fins to assist in guiding said projectile and as it leaves the muzzle, said bore size portions being of an axial length at least as much as their diameter, the nose and body portion being of metal having a density substantially twice that of iron whereby the momentum of said projectile is greater than that of a steel projectile of the same length divided by diameter, and retardation in velocity is reduced during flight.

* * * * *